US007083063B2

(12) United States Patent
Lien

(10) Patent No.: US 7,083,063 B2
(45) Date of Patent: Aug. 1, 2006

(54) HANDLED COVER FOR WATER BAG

(76) Inventor: Chien-Ping Lien, P.O. Box 82-144, Taipei (TW)

( * ) Notice: Subject to any disclaimer, the term of this patent is extended or adjusted under 35 U.S.C. 154(b) by 32 days.

(21) Appl. No.: 10/422,827

(22) Filed: Apr. 25, 2003

(65) Prior Publication Data

US 2004/0211778 A1 Oct. 28, 2004

(51) Int. Cl.
*B65D 41/04* (2006.01)

(52) U.S. Cl. ..... 220/291; 383/66; 222/175

(58) Field of Classification Search ..... 220/219, 220/754, 766, 703, 291; 215/306, 387; 128/DIG. 24; 383/66, 80, 96, 25, 9; 308/66, 80, 96, 25, 308/6; 222/175, 647, 92, 93, 105
See application file for complete search history.

(56) References Cited

U.S. PATENT DOCUMENTS 5,044,512 A * 9/1991 Giancaspro et al. ..... 220/709
5,462,190 A * 10/1995 Lienhart et al. ..... 220/375
5,531,733 A * 7/1996 Scarrow ..... 604/411
5,727,714 A * 3/1998 Fawcett ..... 222/175
5,806,726 A * 9/1998 Ho ..... 222/529
5,881,783 A * 3/1999 Chou ..... 141/351
6,644,854 B1 * 11/2003 Lien ..... 383/66
6,675,998 B1 * 1/2004 Forsman et al. ..... 224/148.2

* cited by examiner

*Primary Examiner*—Lien M. Ngo
(74) *Attorney, Agent, or Firm*—Leong C. Lei

(57) ABSTRACT

A handled cover for water bag comprises a cover, a locking element and a connecter. The locking element is provided on the water bag for coupling with the cover. A handle integrally formed with a buckle ring is mounted on the locking element. Engagement clamps are correspondingly provided on the sides of the buckle ring, while a handle bar of special figure is provided on a side of the buckle ring. A hole is provided on the center of the handle bar. The connecter is connected to the outside of the cover, and provided with a strip in the form of a blunt-headed hook extruding from the rim. By way of having the strip passing through the locking hole on the handle, after the cover is released from the locking element, the cover would not depart from the handle via the connection of the strip on the connecter. And the handle may be freely dismounted and changed the position for resemblance, such that a user may carry the water bag to ease filling water or movement.

2 Claims, 7 Drawing Sheets

HANDLED COVER FOR WATER BAG

BACKGROUND OF THE INVENTION (a) Technical Field of the Invention

The present invention relates to a handled cover for water bag, which could ease a user to hold the water bag when filling water, particularly to a handled cover for water bag especially applicable in sport time.

(b) Description of the Prior Art

Cycling has become a popular outdoor activity in terms of leisure, sports or traffic transportation. People usually mount a rack on a bicycle for holding the water bottle to solve the dinking issue during cycling. And, to make it convenient for the cyclist to drink water from the bottle on the bicycle, a conduit with nozzle may be provided on the cover of the bottle for drinking purposes, such that the cyclist can drink water during cycling, rather than stop to drink. However, in view of the fact that the cover might easily fall off and be lost at the time of being washed and that the user can only hold the locking element when filling water to the water bag, the inventor further disclosed the present invention as an improvement of the water bag, in an attempt to bring more benefits to the users.

SUMMARY OF THE INVENTION

The primary object of the invention is to provide a cover for a water bag, which would not easily fall off and be lost when being washed or re-supplied since the cover can be attached to the water bag.

Another object of the invention is to provide a cover for a water bag, which can ease the user to hold the water bag at the time of filing liquid into the water bag.

A further object of the invention is to provide a cover for a water bag, which may be tuned to present upwardly to ease the user to carry the water bag.

To obtain the above objects, the handled cover according to the invention includes a cover, a locking element, a connecter and a handle. The locking element is provided on the water bag for coupling with the cover. A handle integrally formed with a buckle ring is mounted on the locking element. Engagement clamps are correspondingly provided on the sides of the buckle ring, while a handle bar of special figure is provided on a side of the buckle ring. A hole is provided on the center of the handle bar. The connecter is connected to the outside of the cover, and provided with a strip in the form of a blunt-headed hook extruding from the rim. By way of having the strip passing through the locking hole on the handle, after the cover is released from the locking element, the cover would not depart from the handle via the connection of the strip on the connecter, thereby easing the user to hold the water bag for filing liquid thereinto.

The detailed construction and other characteristics of the present invention can be better understood by way of reading the following descriptions with reference to the accompanied drawings.

DETAILED DESCRIPTION OF THE PREFERRED EMBODIMENT

Figure 1:
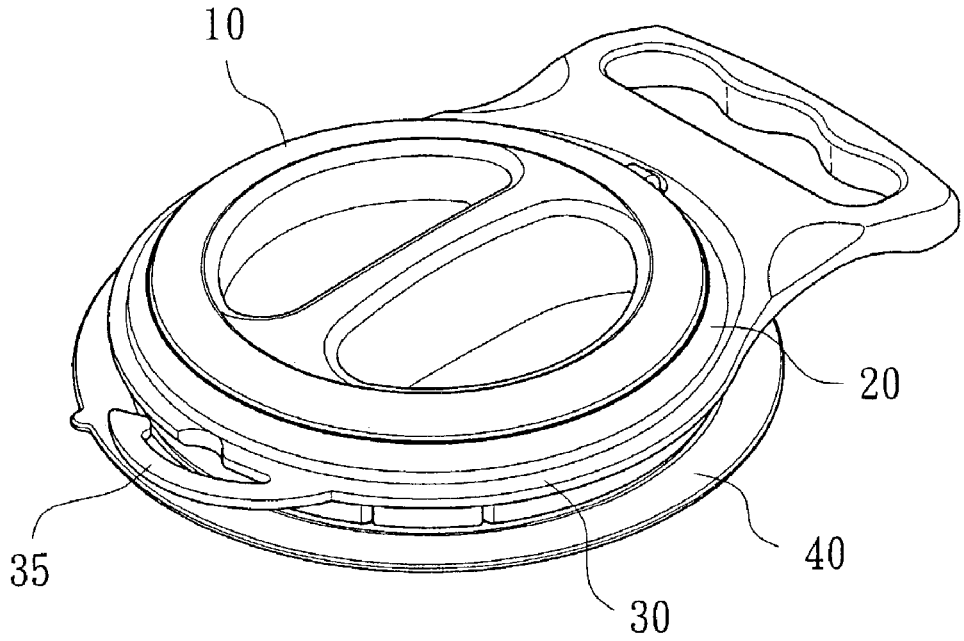
FIG. 1 is a perspective view of an embodiment of the invention.
Figure 2:
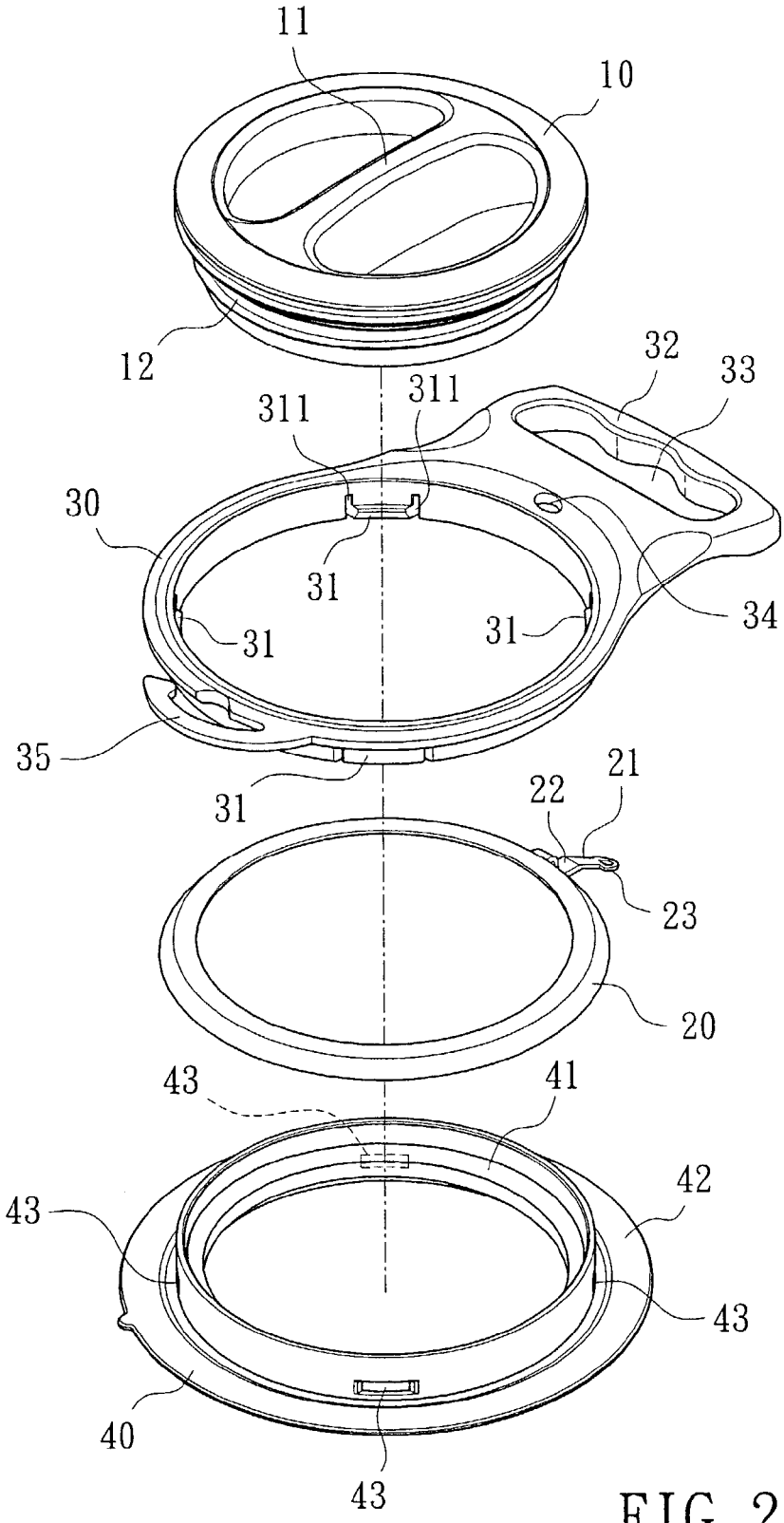
FIG. 2 is an exploded view of an embodiment of the invention.
Figure 3:
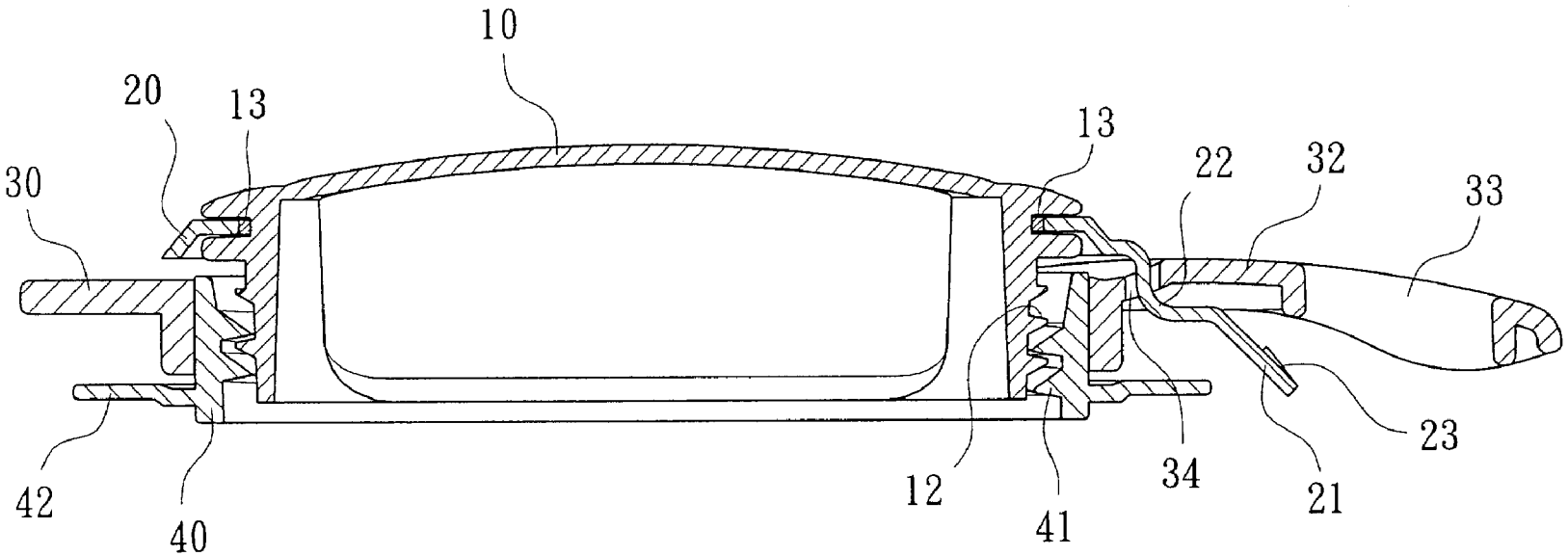
FIG. 3 is a cut-away view of an embodiment of the invention.

Referring to FIGS. 1 and 2, the invention is composed of a cover 10, a connecter 20, a handle 30 and a locking element 40. The top of the cover 10 is provided with two hollows such that a central handle bar 11 is formed in-between the two hollows. Outer threads 12 are extended downwardly from the bottom of the cover 10; and a peripheral groove 13 (as shown in FIG. 3) is provided on the top of the threads.

The connecter 20 has a size matching up that of the cover 10. The periphery of the connecter 20 is provided with a downwardly bending strip 21 which has a bending section 22 and a blunt-headed hook 23 on the end of thereof.

Figure 6:
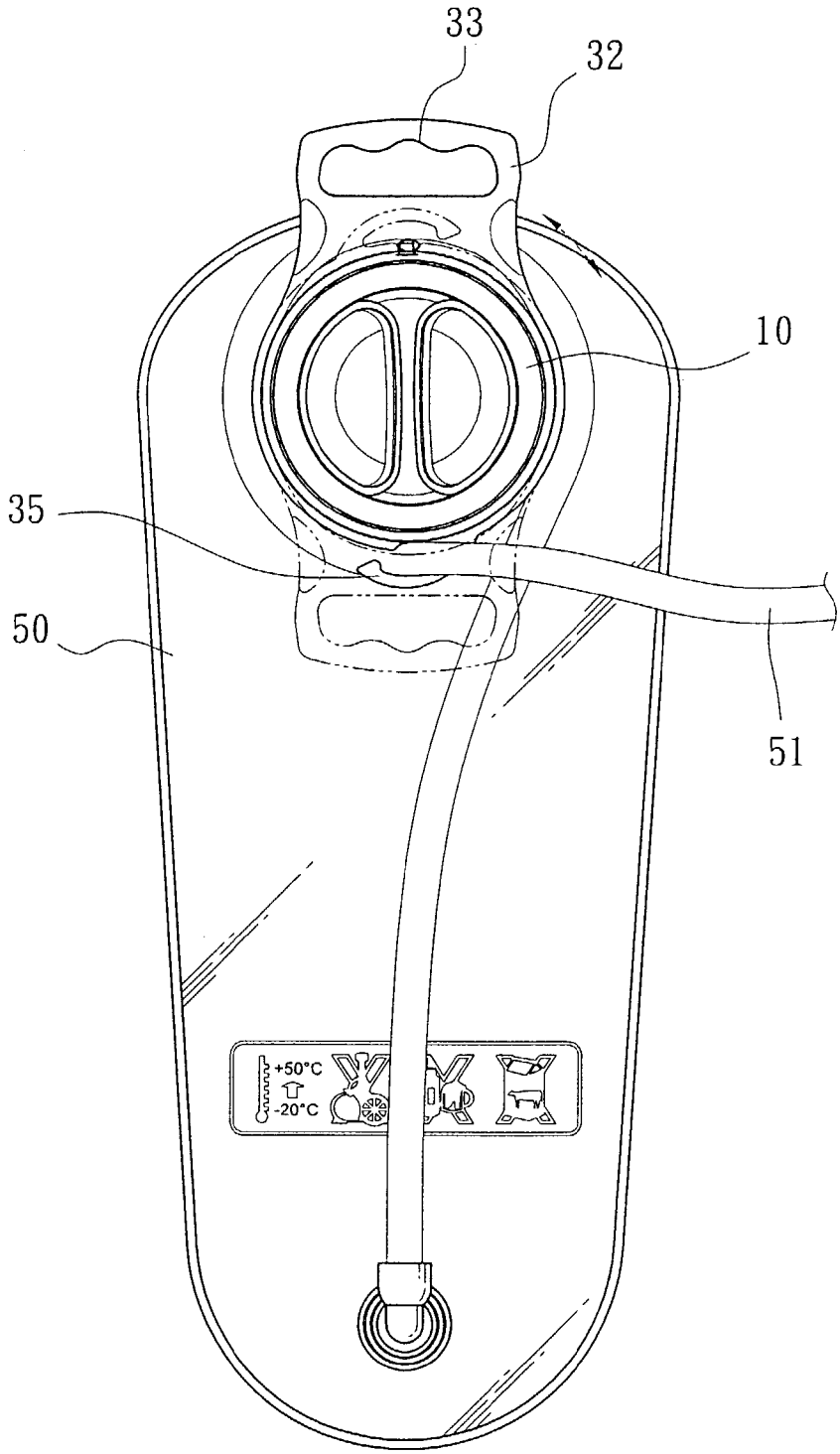
FIG. 6 is a schematic view of the invention when being coupled to a water bag (with the handle upward).

The handle 30 is integrally coupled with a buckle ring which is provided with engagement clamps 31 on the corresponding sides (four engagement clamps 31 are provided in the embodiment) and a special figure of handle bar 32 on one side, while a hole 33 is provided on the handle bar 32 such that the user's finger may insert therein. A locking hole 34 is provided in front of the hole 33. A hook 35 having a hole with an appropriate size is provided for hanging the conduit of the water bag (as shown in FIG. 6).

The locking element 40, which, being in the form of a short cylinder, has an extender 42 laterally expanded from the bottom of the short cylinder. Inner threads 41 capable of coupling with the outer threads 12 on the bottom of the cover 10 are provided on the inner wall of the locking element 40, while a plurality of engagement holes 43 (four engagement holes 43 are provided in the embodiment) are correspondingly provided on the inner wall of the locking element 40 to obtain an excellent coupling effect.

Referring to FIGS. 1 and 3, when the connecter 20 is coupled to the periphery of the cover 10 and the connecter 20 is engaged into the peripheral groove 13 on the top of the cover 10, the cover 10 can be rotatably connected to the connecter 20. Under such a connecting status, the cover 10 may be freely rotated.

The handle 30 is mounted inside of the locking element 40 such that each engagement clamp 31 on the handle 30 may be engaged in each engagement hole 43 on the locking element 40. The strip 21 of the connecter 20 moveably coupled to the cover 10 passes through the locking hole 34, so that the bending section 22 may be inserted into the locking hole 34 and that the blunt-headed hook 23 on the end of the strip 21 may be stock inside of the locking hole 34, thereby the cover 10 can be coupled to the handle 30 without releasing therefrom.

By way of the coupling of the outer threads 12 of the cover 10 with the inner threads 41 on the inner wall of the locking element 40, the cover 10 can be fastened to the locking element 40 to avoid water leakage.

Figure 5:
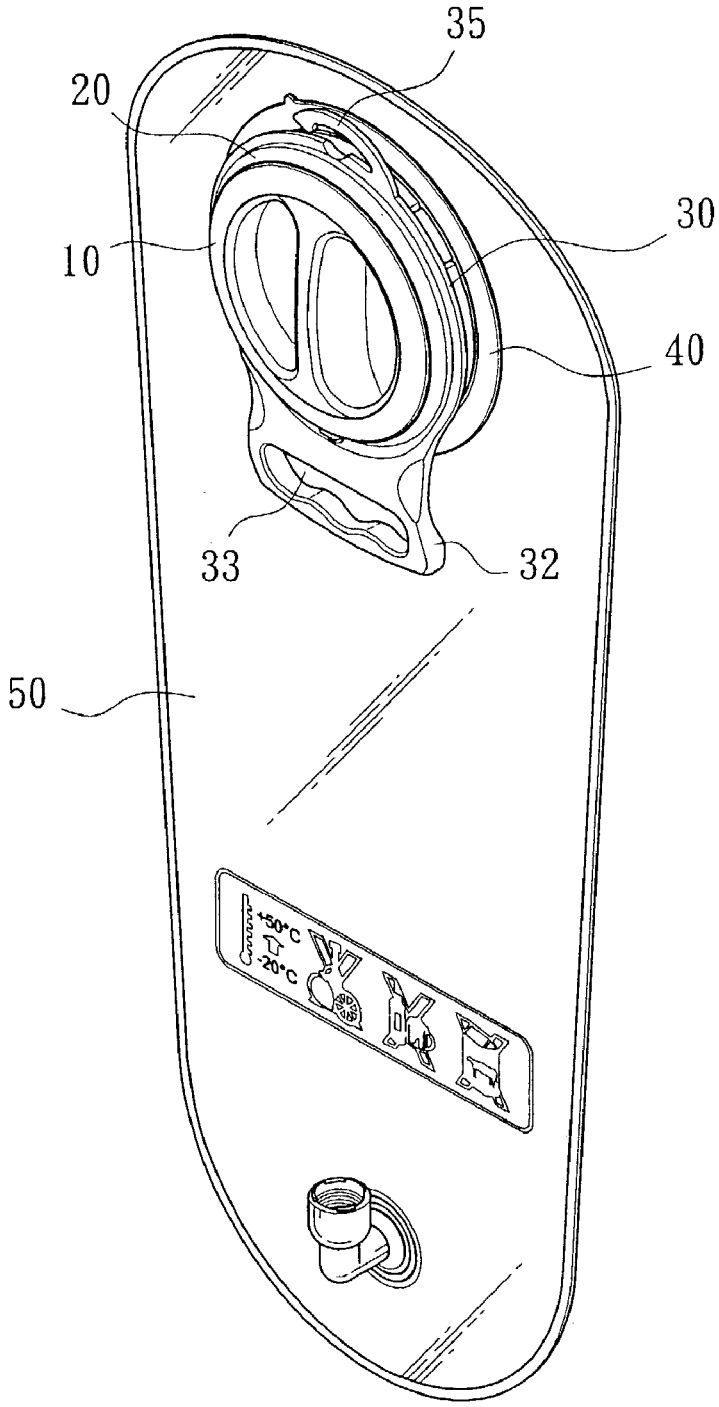
FIG. 5 is a schematic view of the invention when being coupled to a water bag (with the handle downward).

As shown in FIGS. 2, 5 and 6, the engagement clamps 31 may be freely dismounted from the engagement holes 43, while each engagement clamp 31 is provided with flexible seams 311 (as shown in FIG. 2), so that when the handle 30 is pulled by force, the engagement clamps 31 may be removed from the engagement holes 43 easily. After changing the direction of the handle 30, the user may lock the handle 30 to the locking element 40 again. In view of the above, the user may easily turn the handle 30 from the position where the water bag faces up to the position where the water bag faces down in a DIY way. If the user wishes to carry the water bag by hand, he/she may take off the handle 30 and have the handle bar 32 face up to coupled with the water inlet of the water bag 50. Simply by way of the engagement force of the four sets of engagement clamps 31 and engagement holes 43, the handle 30 can be fastened to the water bag for carrying purposes. Besides, the hook 35 provided on the buckle ring of the handle 30 may be used for hanging a conduit 51 and avoid the conduit 51 from being soiled due to falling on the ground.

Figure 4:
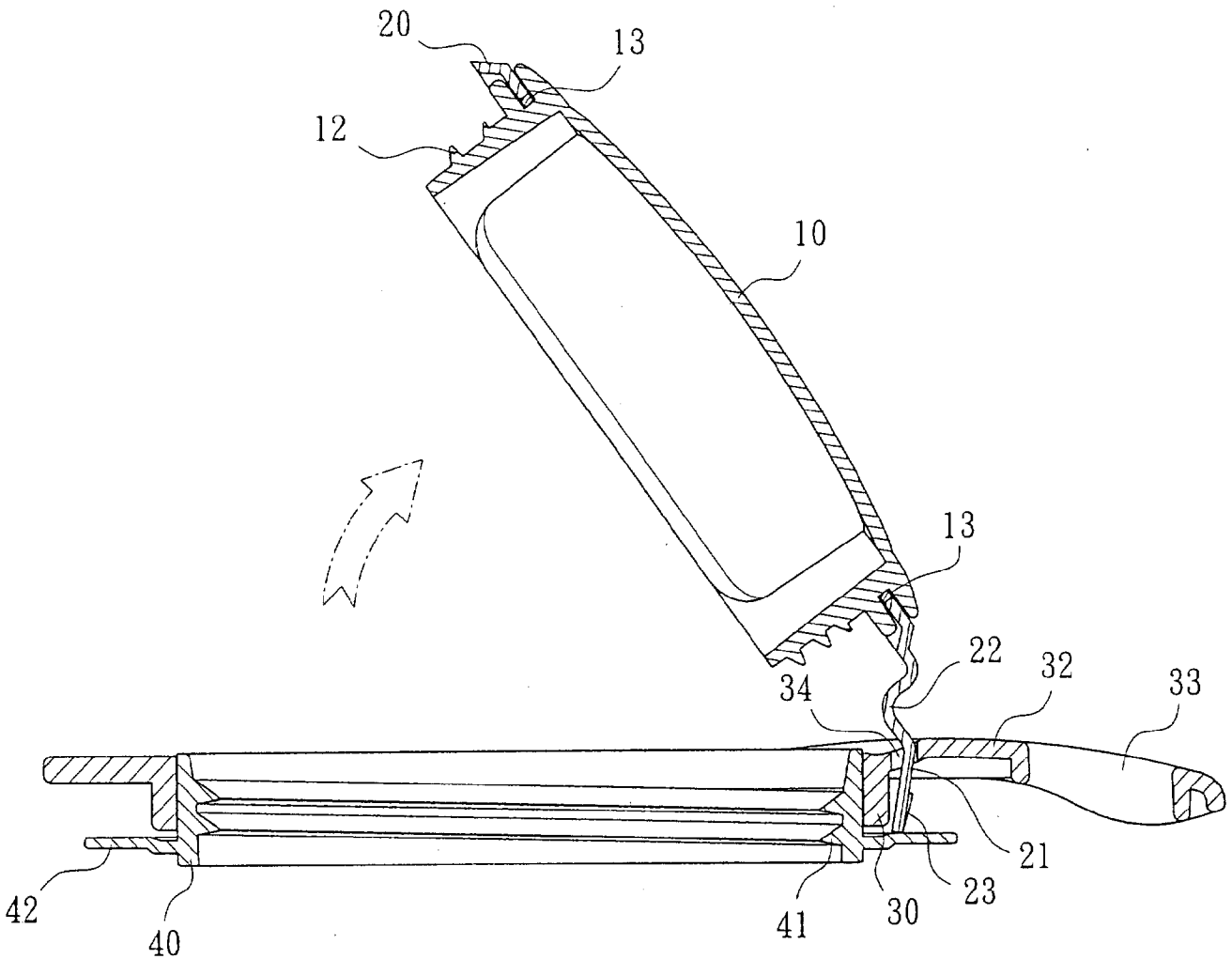
FIG. 4 is a cut-away view of an embodiment of the invention in an open status.
Figure 7:
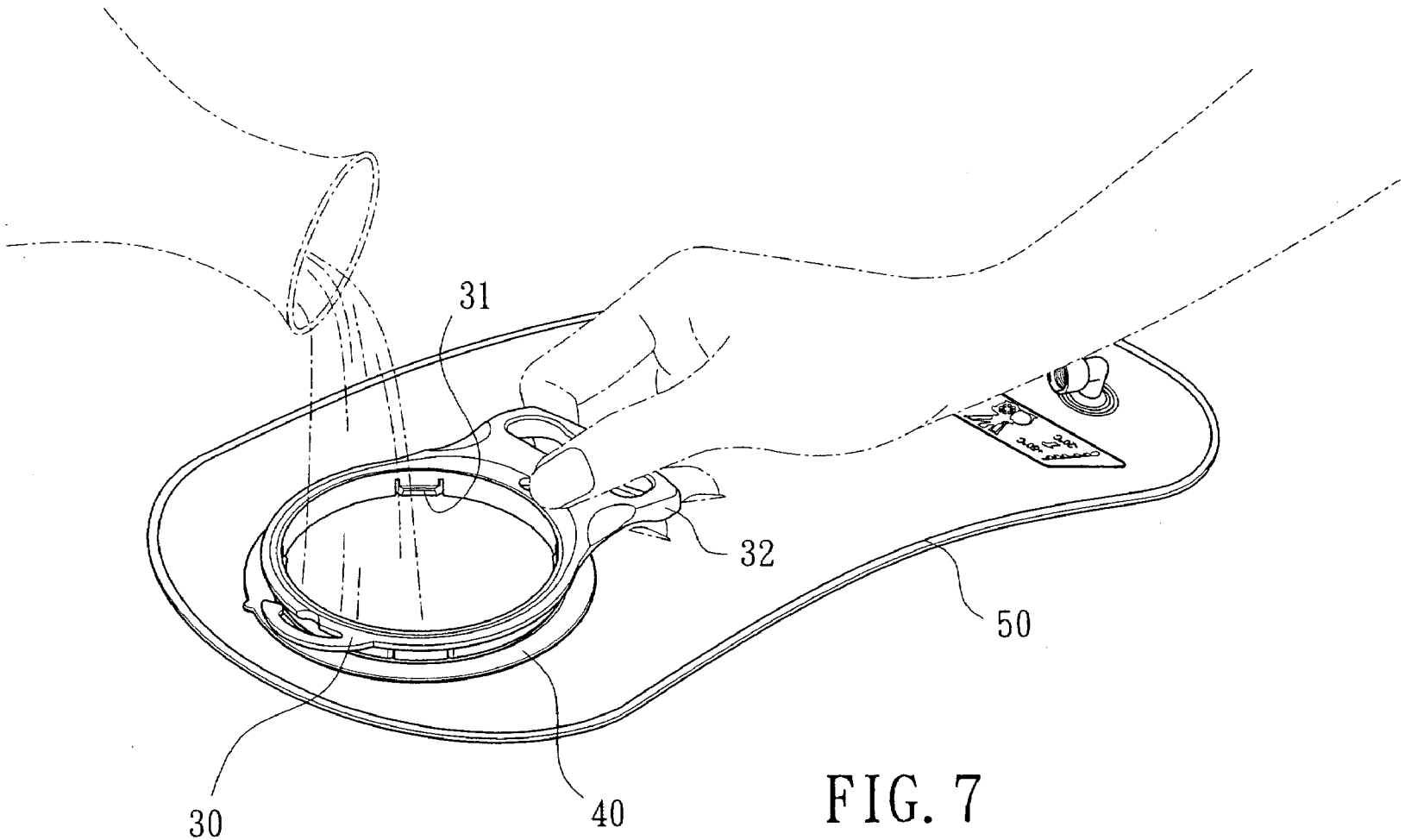
FIG. 7 is an exemplified view showing the use of the downward handle according to the invention when re-filing water.

As shown in FIG. 7, after the above components are assembled together, generally with the handle bar 32 face downwardly to coupled to the inlet of the water bag 50, the user may put his/her fingers through the hole 33 to hold the handle bar 32, and use another hand to hole the central grip 11 of the cover for rotating the cover to loosen the outer threads 12 of the cover 10 from the inner threads 41 of the locking element 40 for filing water into the water bag 50. When the cover 10 is departed from the locking element 40, the blunt-headed hook 23 of the strip 21 on the connecter 20 may be joined inside of the locking hole 34 given the strip's 21 passing through the locking hole 34 of the handle 30, thereby the cover 10 may be connected to the handle 30 via the strip 21 without falling off or being lost (as shown in FIG. 4).

Further referring to FIG. 7, when filling water into the water bag 50, the handle bar 32 shall be downward such that the user's hand can hold the handle bar 32 and the water bag 50 would become downcast due to its weight, thereby the inlet of the water bag 50 presents upwardly to ease the user to pour water into the water bag 50.

Accordingly, the structure according to the invention has the following advantages:

1. By way of simple components, the cover is integrally coupled with the locking element, such that when the cover is rotated to open, it will be connected with the locking element without falling off or being lost.
2. When filling water, the user may easily pour water into the water bag by holding the handle engaged in the locking element.

While certain novel features of this invention have been shown and described and are pointed out in the annexed Claims, it is not intended to be limited to the details above, since it will be understood that various omissions, modifications, substitutions and changes in the forms and details of the device illustrated and in its operation can be made by those skilled in the art without departing in any way from the spirit of the present invention.

For water bag structure disclosed so far, the space development is novel and the utility has been greatly improved, as the inventor claimed in the appended claims.

I claim:

1. A handled cover for a water bag, comprising:

(a) a cover having a top provided with a grip to ease opening said cover and outer threads extended downwardly from a bottom of said cover;

(b) a connecter connected to an outside of said cover and provided with a downwardly bending strip in a form of a blunt-headed hook extruding from a rim of said connecter;

(c) a handle integrally coupled with a buckle ring which is provided with opposite engagement clamps, said buckle ring having one side provided with a handle bar of special figure, said handle bar having a locking hole for passage of said strip and a hole for holding; and (d) a locking element provided with an extender on a bottom of said locking element for coupling with said water bag, inner threads on an interior of said locking element for fastening to said cover, and opposite engagement holes for engaging said engagement clamps, number of said opposite engagement holes being equal to number of said opposite clamps;

whereby, by way of the extender's being fastened to the water bag, the engagement clamps on the handle may be freely engaged with the engagement holes on the locking element, and the connecter may be coupled with the cover; and by way of having the blunt-headed hook on an end of a bending section of the strip on the connecter passing through the locking hole on the handle, the cover may be fastened to the locking element.

2. The handled cover for a water bag according to claim 1, wherein said number of said engagement holes and said engagement clamps is four, and each of said engagement clamps is provided with flexible seams so that when said handle is pulled by force, said engagement clamps can be removed from said engagement holes.

* * * * *